US010962247B2

(12) United States Patent
Aquino

(10) Patent No.: US 10,962,247 B2
(45) Date of Patent: Mar. 30, 2021

(54) OFFSET WINDOW FAN

(71) Applicant: Antonio Aquino, Los Angeles, CA (US)

(72) Inventor: Antonio Aquino, Los Angeles, CA (US)

( * ) Notice: Subject to any disclaimer, the term of this patent is extended or adjusted under 35 U.S.C. 154(b) by 0 days.

(21) Appl. No.: 16/417,122

(22) Filed: May 20, 2019

(65) Prior Publication Data

US 2020/0018499 A1 Jan. 16, 2020

Related U.S. Application Data

(63) Continuation-in-part of application No. 16/036,266, filed on Jul. 16, 2018.

(51) Int. Cl.
*F24F 11/00* (2018.01)

(52) U.S. Cl.
CPC ..... *F24F 11/0001* (2013.01)

(58) Field of Classification Search
CPC ..... F24F 11/0001; F24F 11/74; F24F 11/79; F24F 2110/12; F24F 7/013
See application file for complete search history.

(56) References Cited

U.S. PATENT DOCUMENTS 2,467,297 A * 4/1949 Doe ..... F24F 7/013 454/200
2,528,301 A * 10/1950 Doe ..... F24F 7/013 454/207
3,753,184 A 8/1973 Holloway et al.
3,799,245 A 3/1974 Ferdelman
3,951,625 A * 4/1976 Follette ..... F24F 3/14 96/251
4,018,266 A 4/1977 Kay
4,136,822 A 1/1979 Felter
4,773,310 A * 9/1988 Corwin ..... F24F 3/1603 454/210
4,987,952 A 1/1991 Beal et al.
5,000,381 A 3/1991 Mueller et al.
5,005,636 A 4/1991 Haessig
5,065,585 A 11/1991 Wylie et al.
5,197,299 A * 3/1993 Sohn ..... F24F 1/027 312/101
5,239,834 A 8/1993 Travers
(Continued)

FOREIGN PATENT DOCUMENTS

JP 2000121132 A * 4/2000 ..... F24F 1/0035

*Primary Examiner* — Steven S Anderson, II
(74) *Attorney, Agent, or Firm* — Averill & Green; Kenneth L. Green

(57) ABSTRACT

An offset window mount fan includes two or more independently controlled fans controllable to move air in the same direction or in opposite directions. A housing substantially offsets the fans from a direct passage of air into the room. In one embodiment, the fans are mounted in a housing perpendicular to the window, air traveling through the fans turning 90 degrees to pass through the plane of the window and 90 degrees down into the room. Each fan includes a temperature sensor to measure temperature of air moving through each fan. The fans are energized periodically for a short time period to make accurate temperature measurements. When the combined temperature measurements indicate an advantage from fan operation, the fans are activated.

5 Claims, 10 Drawing Sheets

(56) References Cited

U.S. PATENT DOCUMENTS

| | | | | |
|---|---|---|---|---|
| 5,626,288 | A | 5/1997 | Huber | |
| 6,283,851 | B1 | 9/2001 | Smith et al. | |
| 6,364,024 | B1 | 4/2002 | Dallas | |
| 6,388,878 | B1 * | 5/2002 | Chang | G06F 1/20 361/679.48 |
| 8,079,898 | B1 | 12/2011 | Stevenson | |
| 8,118,236 | B2 | 2/2012 | Lestage et al. | |
| 8,156,797 | B2 | 4/2012 | Murray et al. | |
| 8,543,244 | B2 | 9/2013 | Keeling et al. | |
| 9,625,170 | B2 | 4/2017 | Aquino | |
| 2006/0273183 | A1 | 12/2006 | Cavanagh et al. | |
| 2008/0054085 | A1 | 3/2008 | Case | |
| 2009/0013703 | A1 | 1/2009 | Werner | |
| 2009/0014545 | A1 | 1/2009 | Horiuchi | |
| 2011/0159795 | A1 | 6/2011 | Sprague | |
| 2012/0190292 | A1 | 7/2012 | Skrepcinski | |
| 2015/0184884 | A1 * | 7/2015 | Aquino | F24F 11/76 165/250 |
| 2015/0285524 | A1 * | 10/2015 | Saunders | F24F 11/77 454/239 |

* cited by examiner

OFFSET WINDOW FAN

CROSS-REFERENCE TO RELATED APPLICATIONS

The present application is a Continuation In Part of U.S. patent application Ser. No. 16/036,266 filed Jul. 16, 2018, which application is incorporated in its entirety herein by reference.

BACKGROUND OF THE INVENTION

The present invention relates to room temperature control and in particular to wall mounted fans.

Wall mounted fans are often used to provide cool outside air to a room when cooling is desired, or warm outside air to a room when heating is desired. The fans generally compare room temperature to a temperature setting, and activate the fan when the room temperature exceeds the setting for cooling and activate the fan when room temperature is less than the setting for heating. In many instances, the fan is operated when outside air is above the inside air temperature when cooling is desired or below the inside air temperature when heating is desired, providing an undesirable result.

Further, window fans are generally thin and have very little resistance to air passing through the fan when the fan is not on. On a windy day, either hot or cold outside air may enter the room creating an undesired result. The known fans also block a large portion of the window at least as large and the area of the fan.

BRIEF SUMMARY OF THE INVENTION

The present invention addresses the above and other needs by providing an offset window mount fan including two or more independently controlled fans controllable to move air in the same direction or in opposite directions. A housing substantially offsets the fans from a direct passage of air into the room. In one embodiment, the fans are mounted in a housing perpendicular to the window, air traveling through the fans turning 90 degrees to pass through the plane of the window and 90 degrees down into the room. Each fan includes a temperature sensor to measure temperature of air moving through each fan. The fans are energized periodically for a short time period to make accurate temperature measurements. When the combined temperature measurements indicate an advantage from fan operation, the fans are activated.

In accordance with one aspect of the invention, there is provided an offset window fan housing having an outside portion containing at least one fan. The housing positions the partially, or totally offset from the window. In one embodiment, a housing has a narrow horizontal waist portion resting on a window sill, an exterior portion outside the window turning down, and an interior portion inside the room and turning down. At least one fan is in the exterior portion and has a fan axis (the direction air flows) perpendicular to the window. The thin waist portion minimizes the window area blocked by the fan and the downward interior and exterior portions prevent or reduce air flow due to wind.

In accordance with another aspect of the invention, there is provided a method for controlling a dual fan for heating a room. The method includes setting the dual fan to heating. Selecting a desired heating temperature setting. Briefly operating fans in opposing directions to create opposing air flow in and flow out. Measuring the temperature To in the flow in and Ti in the flow out. If the room temperature is below the heating temperature setting, and To is greater than Ti, operating the dual fan to bring in outside air.

In accordance with yet another aspect of the invention, there is provided a method for controlling a dual fan for cooling a room. The method includes setting the dual fan to cooling. Selecting a desired cooling temperature setting. Briefly operating fans in opposing directions to create opposing air flow in and flow out. Measuring the temperature To in the flow in and Ti in the flow out. If the room temperature is above the cooling temperature setting, and To is less than Ti, operating the dual fan to bring in outside air.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Where the terms "about" or "generally" are associated with an element of the invention, it is intended to describe a feature's appearance to the human eye or human perception, and not a precise measurement.

Figure 1A:
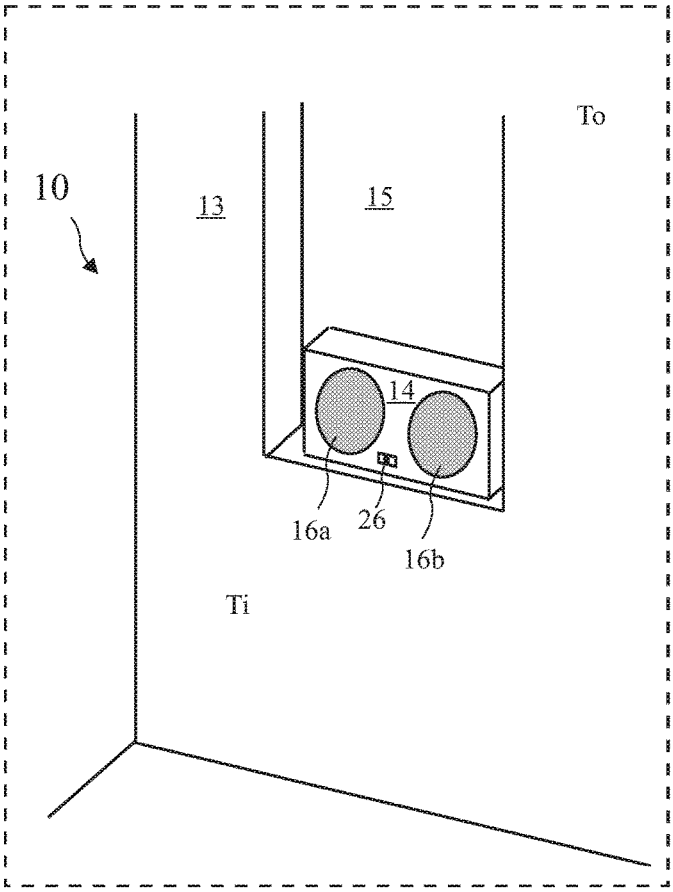
FIG. 1A shows rooms including a dual wall fan according to the present invention.
Figure 1B:
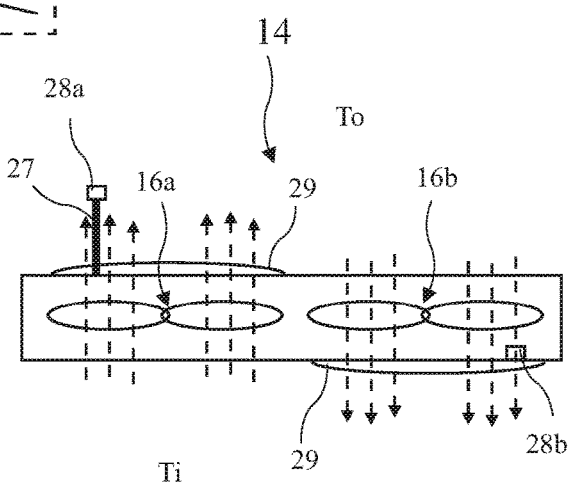
FIG. 1B shows a top view of the dual wall fan according to the present invention.

A temperature controlled area 10 including a dual wall fan (for example a window fan) 14 according to the present invention are shown in FIG. 1A and a top view of the dual wall fan 14 in operation is shown in FIG. 1B. The dual wall fan 14 is mounted to an external wall 13, preferably in windows 15. The dual wall fan 14 includes controls 26, preferably as part of dual wall fan 14 (but may be wired or wireless remote controls), electrically connected (wired or wirelessly) to a processor 50 (see FIG. 6). The controls 26 allow a user to select heating or cooling and a temperature target Tt determining if and when the wall fan 14 will be utilized. Further, in one embodiment, the user sets a lower temperature Tl and a higher temperature Th further determining if and when the wall fan 14 will be utilized.

The fans 16*a* and 16*b* are operated periodically in opposite directions and an outdoor temperature sensor 28*a* measures outdoor temperature To in an air flow out of the room due to one of the fans 16*a* or 16*b*, and in indoor temperature sensor 28*b* measures an indoor temperature Ti in an air flow into the room due to the other one of the fans 16*a* or 16*b*. The sensors 28*a* and 28*b* may be inside the dual wall fan 14, on grills 29 of the dual wall fan 14, or extended on rods 27 reaching into and out of the room 13. The temperatures Tt, Tl and Th, To, and Ti are all provided to a processor 50 (see FIG. 6).

The processor 50 determines if the wall fan 14 should be energized or de-energized, based on the method of FIGS. 2-5. The sensors 28*a* and 28*b* are electrically connected to the controls 26. The controls 26 controls power provided to the dual wall fan 14.

Figure 2:
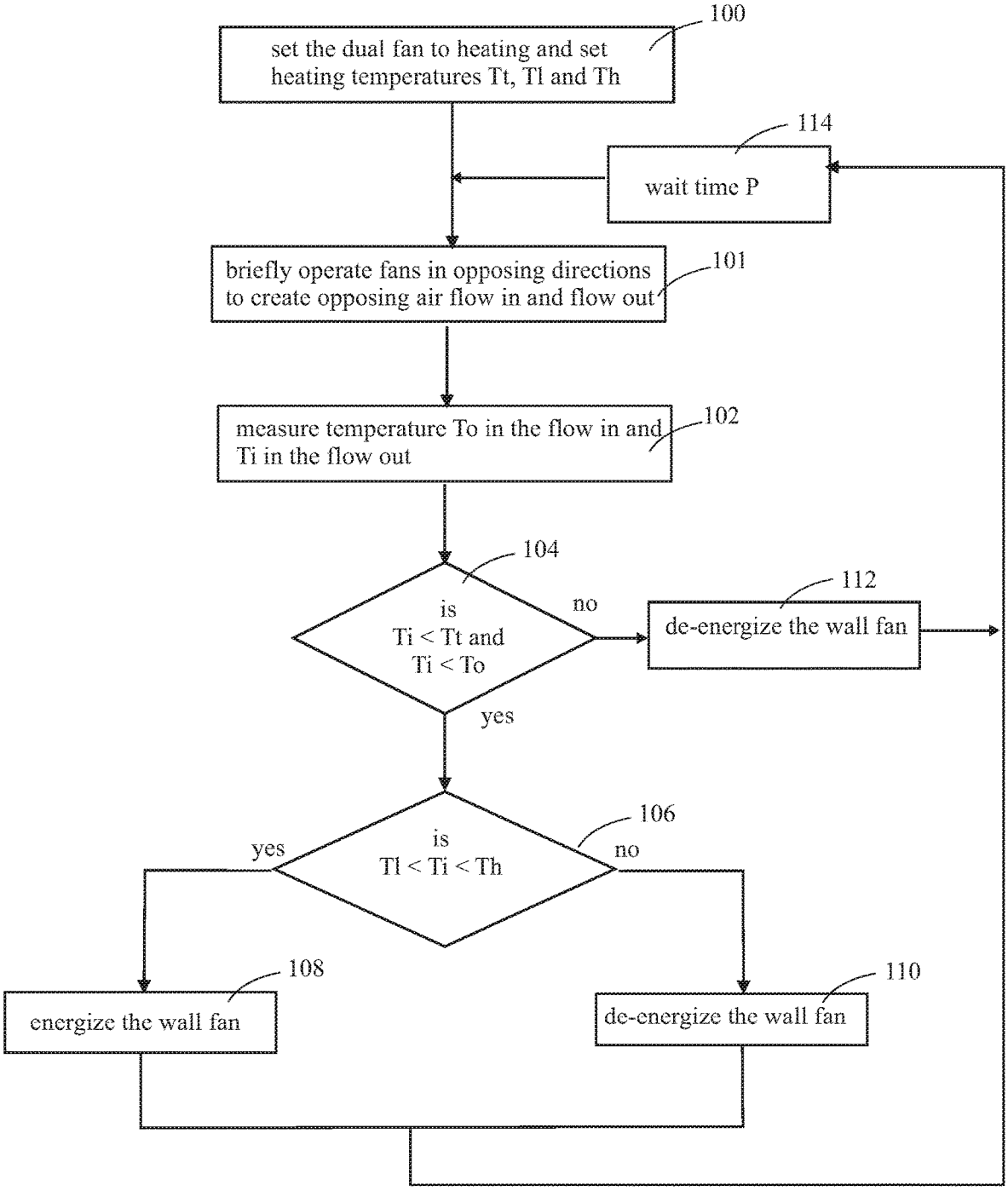
FIG. 2 shows a heating method according to the present invention.

FIG. 2 shows a heating method according to the present invention. The method includes: setting heating mode, a target temperature Tt, a low temperature Tl, and a high temperature Th at step 100; briefly, for a sample period of time (for example, for five seconds), operate fans in opposing directions to create opposing air flow in and flow out at step 101; measuring an outdoor temperature To and an indoor temperature Ti at step 102; comparing Ti to Tt, and To and Ti at step 104; If Ti is not less than Tt, or To is not greater than Ti at step 104, de-energize the wall fan at step 112, waiting a period of time P at step 114, and then repeating measuring the outdoor temperature To and the indoor temperature Ti, otherwise, if Ti is less than Tt (heating is desired) and To is greater than Ti (i.e., can use outdoor air to heat the room), then if Tl is less than Ti and Ti is less than Th at step 106, energizing the wall fan at step 108 or alternatively de-energizing the wall fan at step 110, and after the period of time P at step 114, again briefly operating the fans and measuring the outdoor temperature To and the indoor temperature Ti and repeating steps 104 through 110. The temperature Tl is a lower preferred indoor temperature and the temperature Th is a higher preferred indoor temperature. The sample period of time is preferably between three and ten seconds, and is more preferably five seconds. The waiting time P is preferably between 15 and 30 minutes, and more preferably 20 minutes.

Figure 3:
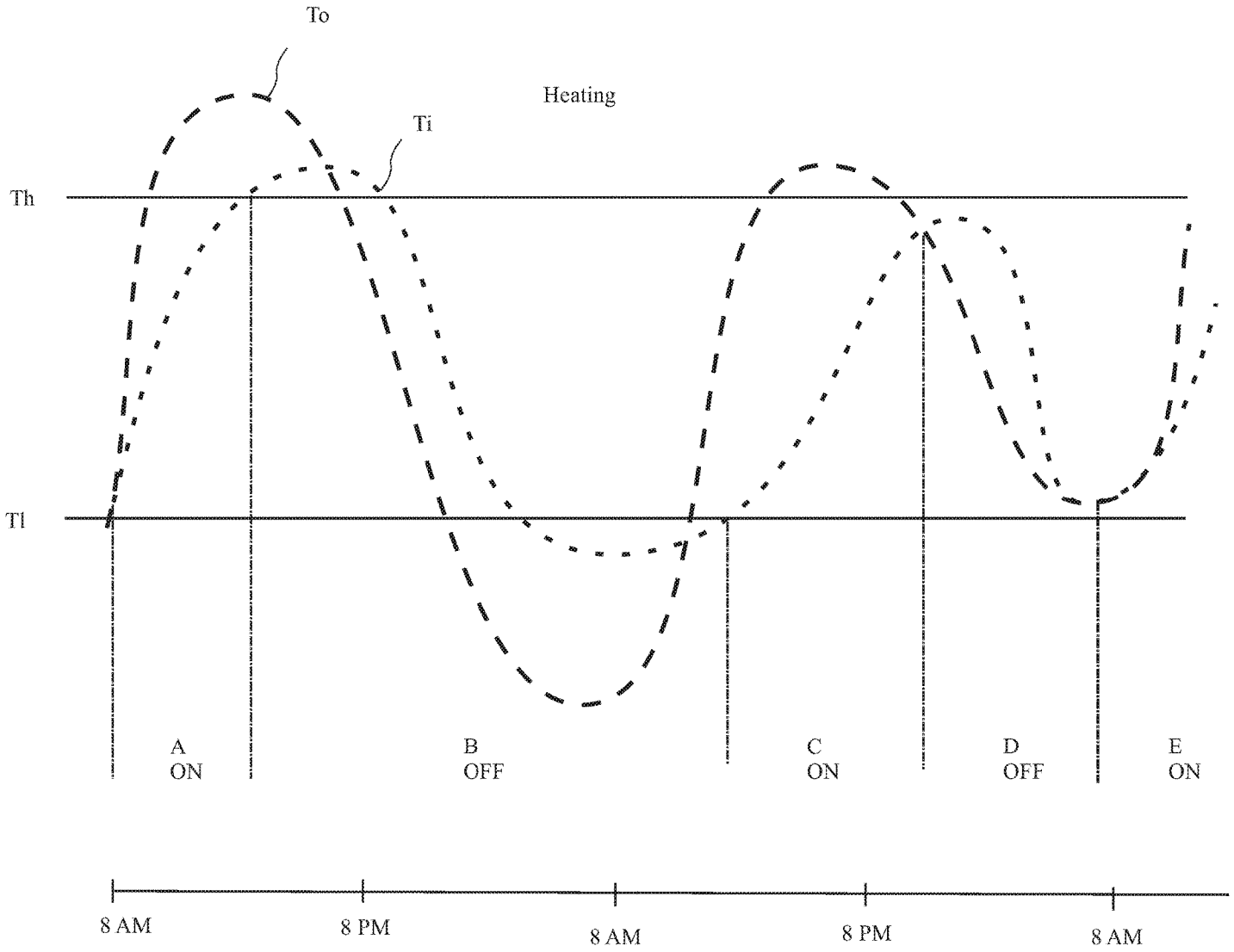
FIG. 3 shows the operation of the heating method according to the present invention in operation.

FIG. 3 shows the method of FIG. 2 controlling a wall fan in heating mode when heating desired. In interval A Ti is between Tl and Th, and To is greater than Ti, so the wall fan is energized to take advantage of the outdoor air to heat the room. During interval B Ti is greater than Th, or To is less than Ti and the wall fan is de-energize. During interval C Ti remains between Tl and Th and To is greater than Ti, so the wall fan is energized to take advantage of the outdoor air to heat the room. During interval D To is less than Ti and the wall fan is de-energized. During interval E, Ti remains between Tl and Th and To is greater than Ti, so the wall fan is energized to take advantage of the outdoor air to heat the room.

Figure 4:
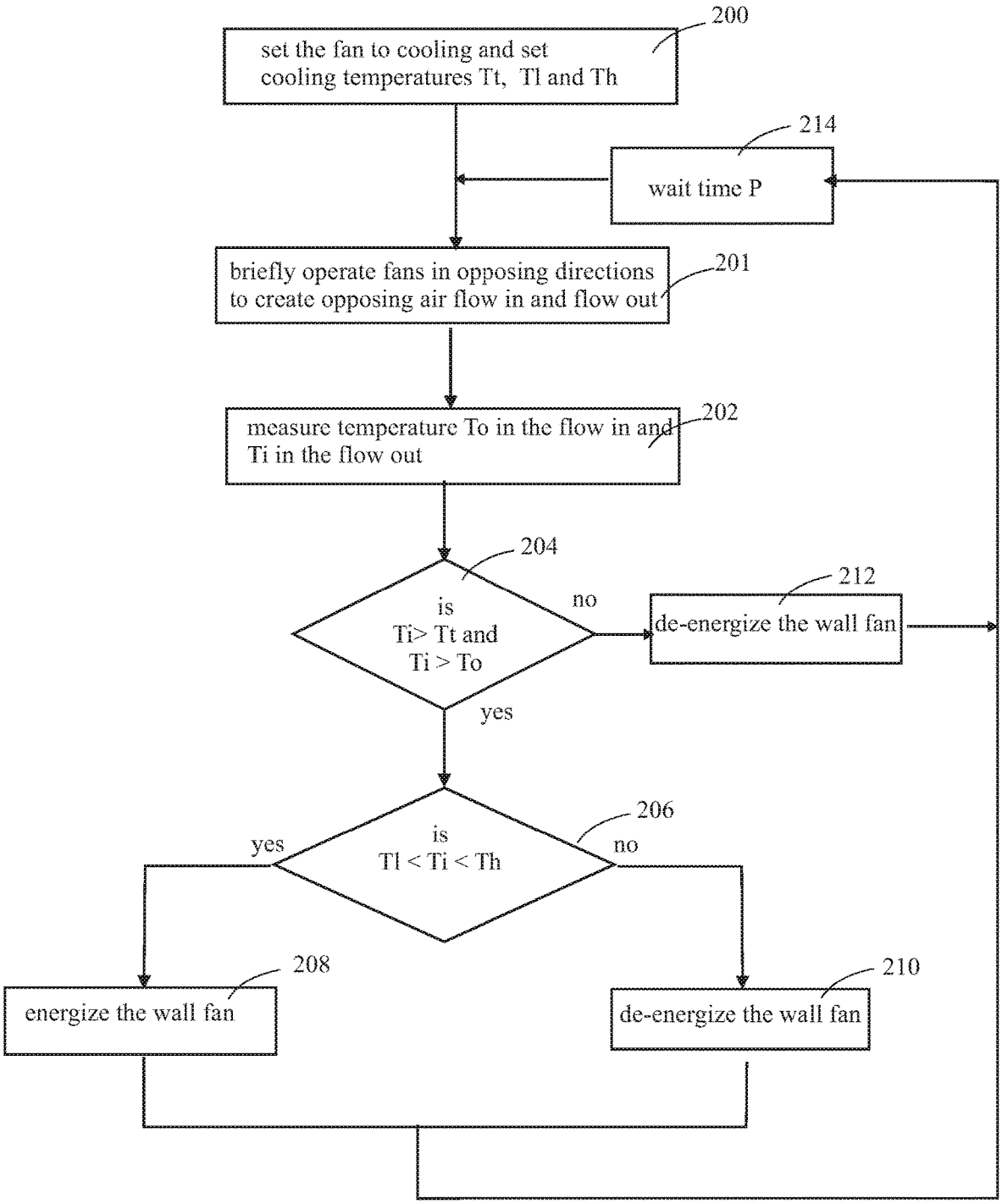
FIG. 4 shows a cooling method according to the present invention

FIG. 4 shows a cooling method according to the present invention. The method includes: setting cooling mode, a target temperature Tt, the lower temperature Tl, and the higher temperature at step 200; briefly, for the sample period of time, operating fans in opposing directions to create opposing air flow in and flow out at step 201; measuring an outdoor temperature To and an indoor temperature Ti at step 202; comparing Ti to Tt and Ti and To at step 204; If Ti is not greater than Tt or Ti is not greater than To at step 204, de-energize the wall fan at step 212, waiting a period of time P at step 214, and then repeating measuring the outdoor temperature To and the indoor temperature Ti, otherwise, if Ti is greater than Tt (cooling is desired), and Ti is greater than To (i.e., can use outdoor to cool the room), if Tl is less than Ti and Ti is less than Th at step 206, energize the dual wall fan at step 208 or alternatively de-energize the dual wall fan at step 210, and after the period of time P at step 214, again briefly operating fans and measuring the outdoor temperature To and the indoor temperature Ti and repeating steps 204 through 210.

Figure 5:
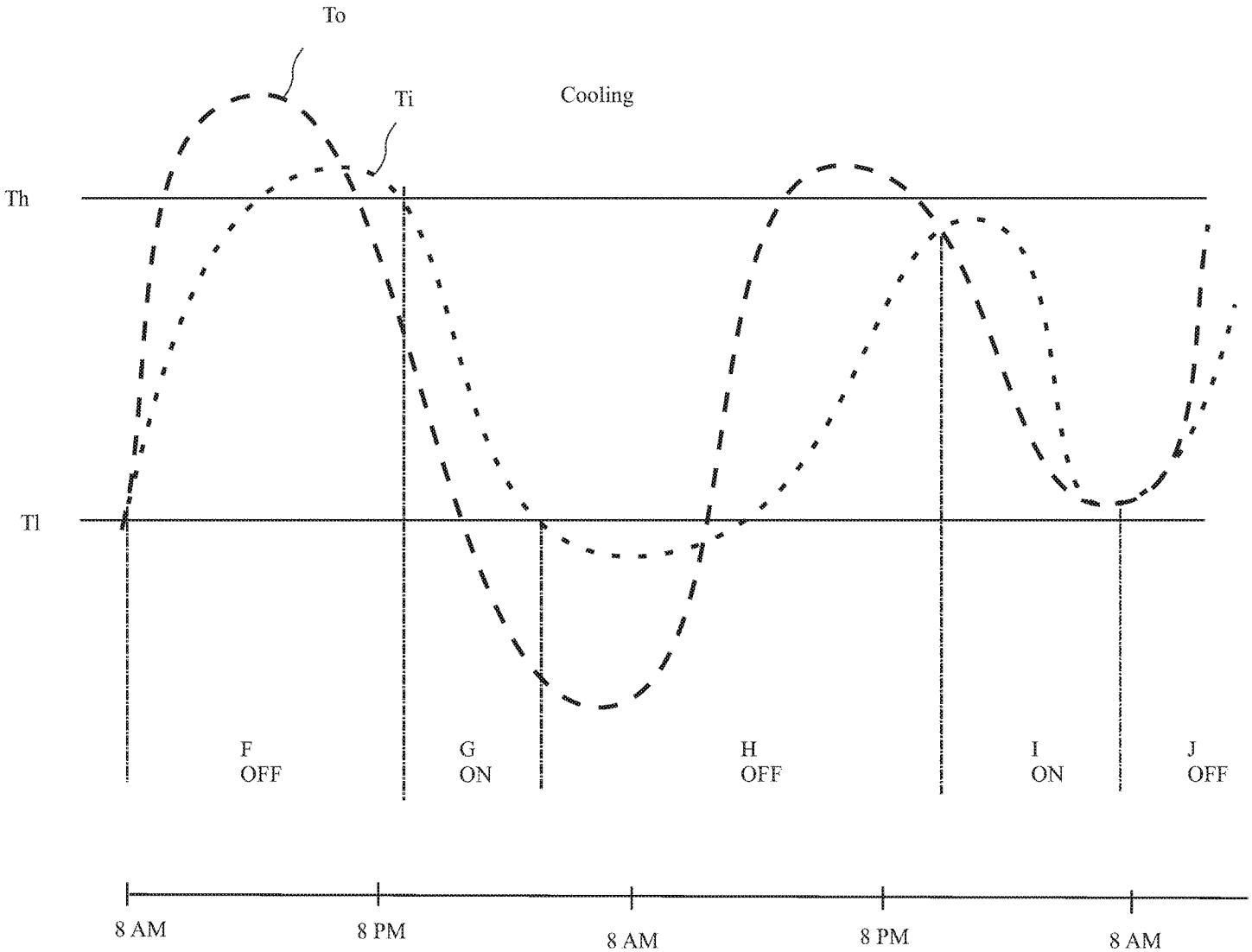
FIG. 5 shows the operation of the cooling method according to the present invention.

FIG. 5 shows the method of FIG. 4 controlling a wall fan in cooling mode when cooling is desired and cool outside air is available. In interval F, either To is greater than Ti or Ti is greater than Th, so the wall fan is de-energized. During interval G, Ti is between Tl and Th, and To is less than Ti so the wall fan is energized to take advantage of cooler outdoor air. During interval H, either Ti is less than Tl or To is greater than Ti, so the wall fan is de-energized. During interval I, Ti is between Tl and Th, and To is less than Ti so the wall fan is energized to take advantage of cooler outdoor air. During interval J, To is greater than Ti, so the wall fan is de-energized.

Figure 6:
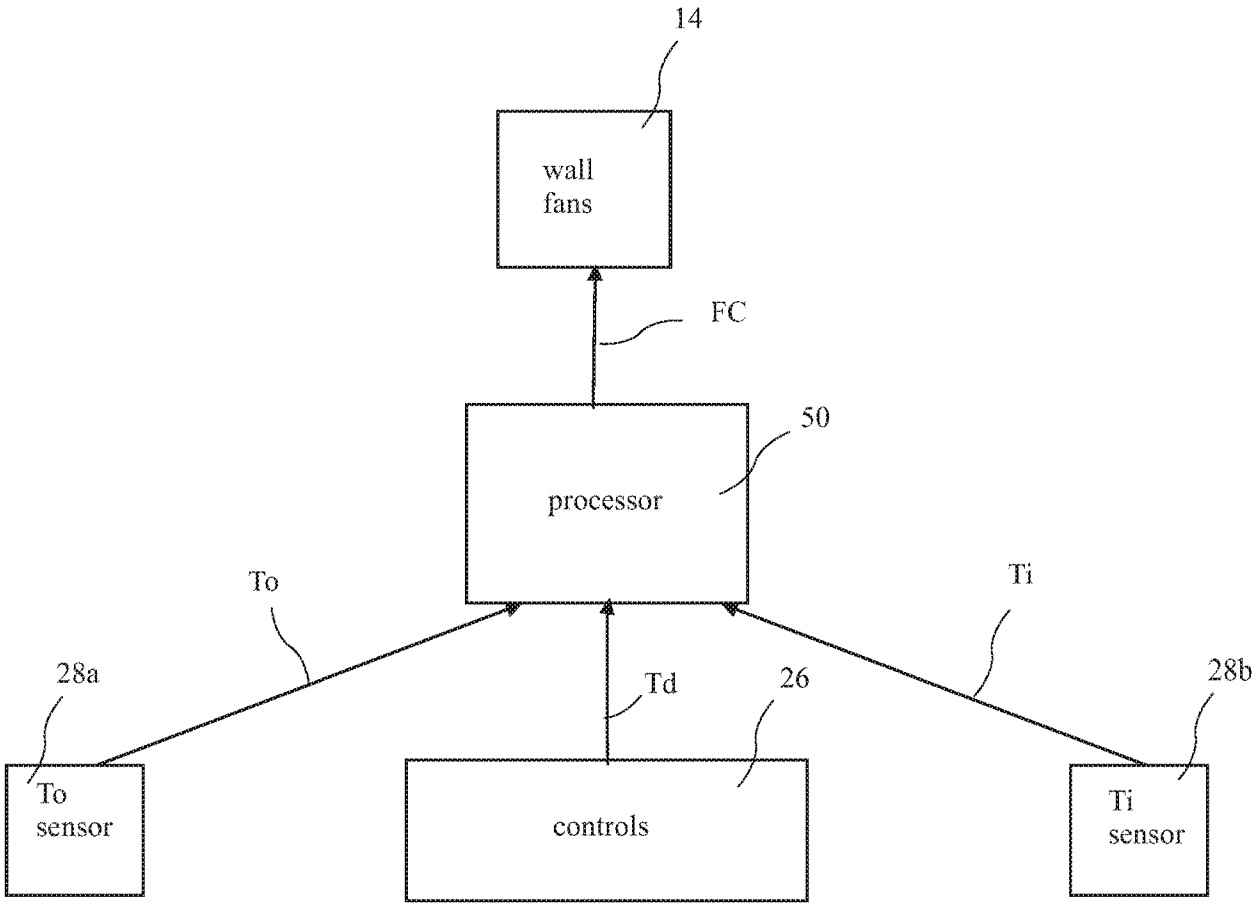
FIG. 6 shows a circuit according to the present invention.

A circuit according to the present invention for controlling the dual wall fan 14 is shown in FIG. 6. The controls 26, sensors 28*a* and 28*b*, and dual wall fan 14 may be connected by wires or be wireless, for example BLUETOOTH®, wireless communications.

Figure 7A:
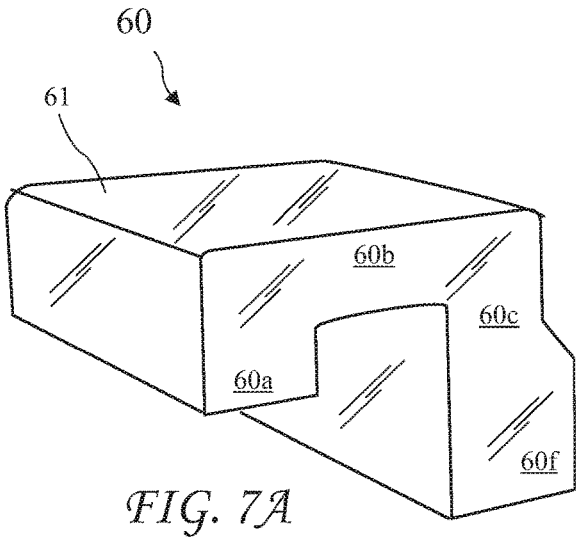
FIG. 7A is a perspective top, side, interior view of an offset window fan according to the present invention.
Figure 7B:
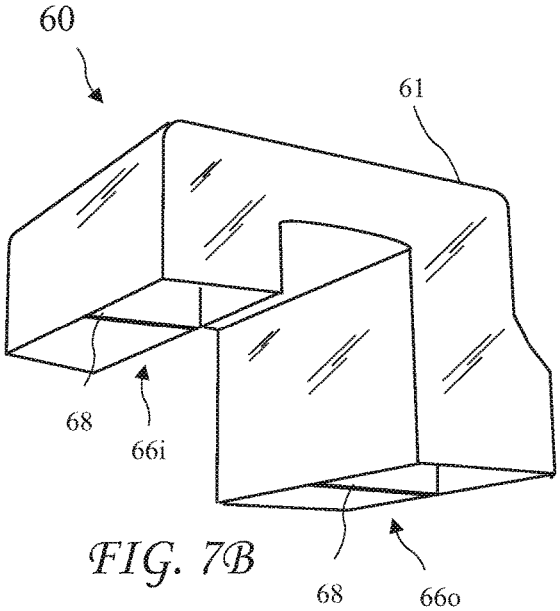
FIG. 7B is a perspective bottom, side, interior view of the offset window fan according to the present invention.

A perspective top, side, interior view of an offset window fan 60 is shown in FIG. 7A and a perspective bottom, side, interior view of the offset window fan 60 is shown in FIG. 7B. The offset window fan 60 includes a housing 61 having a center or thin waist portion 60*b* which minimizes the window 15 (see FIG. 8) area blocked by the offset window fan 60, a downward reaching interior portion 60*a* inside the room, a downward reaching exterior portion 60*c*, and fan portion 60*f*. The three portions of the offset window fan 60 prevent or reduce air flow through the offset window fan 60 due to wind. The offset window fan 60 may include only one fan, but in some embodiments includes two or more fans and the interior of the offset window fan 60 may include one or more dividers 68 separating air flows through openings 66*o* and 66*i* through the offset window fan 60.

While the offset window fan 60 has been described as having the downward reaching interior and exterior portions 60*a* and 60*c*, in other embodiments the interior and exterior portions may simply be offset to some degree from the center portion to reduce overlap between the window 15 and the interior and exterior portions. For example, an air flow through the offset window fan 60 may be entirely horizontal.

Figure 8:
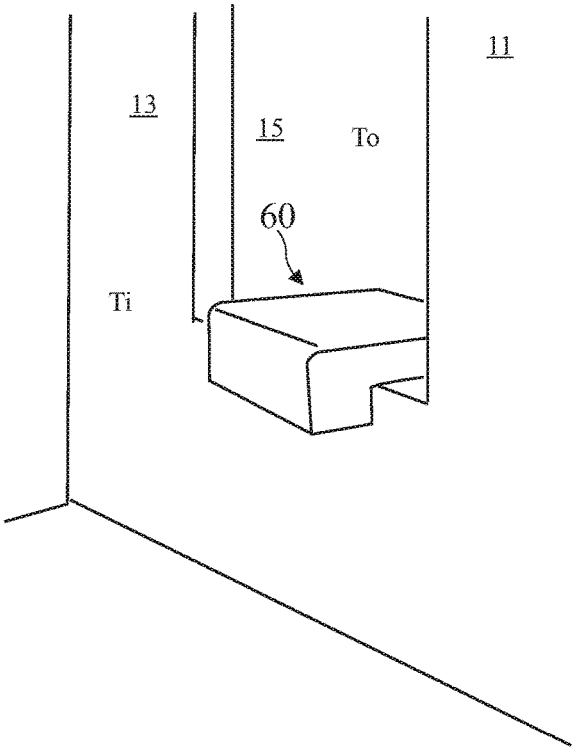
FIG. 8 shows the offset window fan according to the present invention mounted in a window.

FIG. 8 shows the offset window fan 60 mounted in the window 15 reaching out into an exterior 11.

Figure 9B:
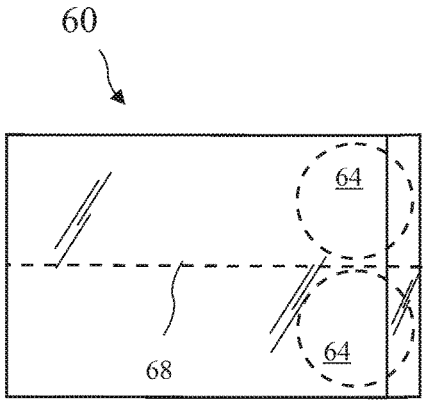
FIG. 9B is a top view of the offset window fan according to the present invention.
Figure 9D:
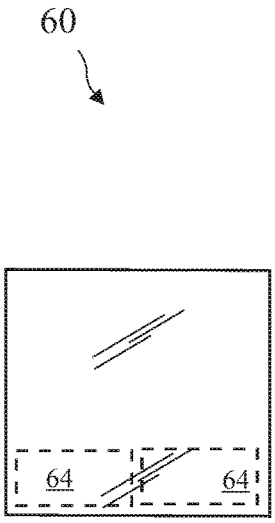
FIG. 9D is an interior view of the offset window fan according to the present invention.
Figure 9A:
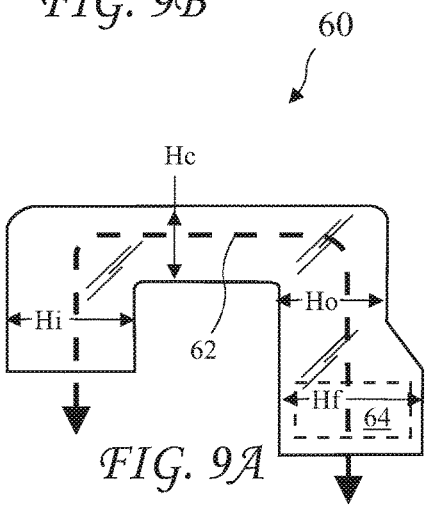
FIG. 9A is a side view of the offset window fan according to the present invention.
Figure 9E:
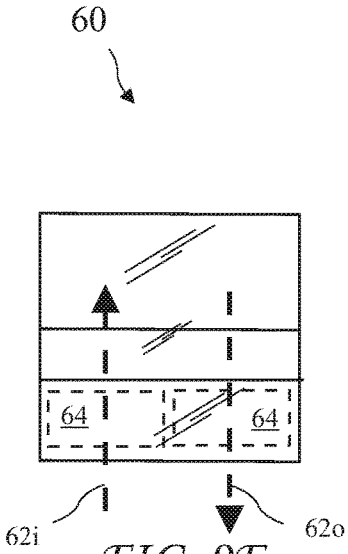
FIG. 9E is an exterior view of the offset window fan according to the present invention.
Figure 9C:
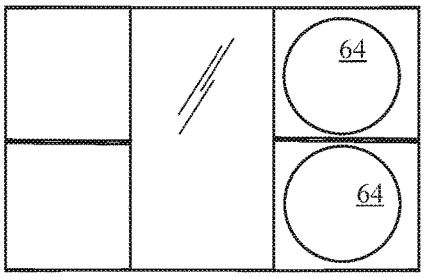
FIG. 9C is a bottom view of the offset window fan according to the present invention.

A side view of the offset window fan 60 is shown in FIG. 9A, a top view of the offset window fan 60 is shown in FIG. 9B, a bottom view of the offset window fan 60 is shown in FIG. 9C, an interior view of the offset window fan 60 is shown in FIG. 9D, and an exterior view of the offset window fan 60 is shown in FIG. 9E, showing an embodiment having two fans 64. The offset window fan 60 is separated to have two air flows, for example an inward airflow 62*i* and an outward air flow 62*o*. The fans are controllable to provide the airflows 62 in either directions a desired and discussed above. The offset window fan 60 further includes the sensors and controls described above for the dual wall fan 14 based on indoor temperature ti and outdoor temperature to (see FIG. 8). The interior portion 60*a* has a height (the dimension perpendicular to the air flow) Hi, the center portion 60*b* had a height Hc, the exterior portion 60*c* has a height (the dimension perpendicular to the air flow) Ho, and a fan portion 60*f* has a height (the dimension perpendicular to the air flow) Hf.

Figure 10:
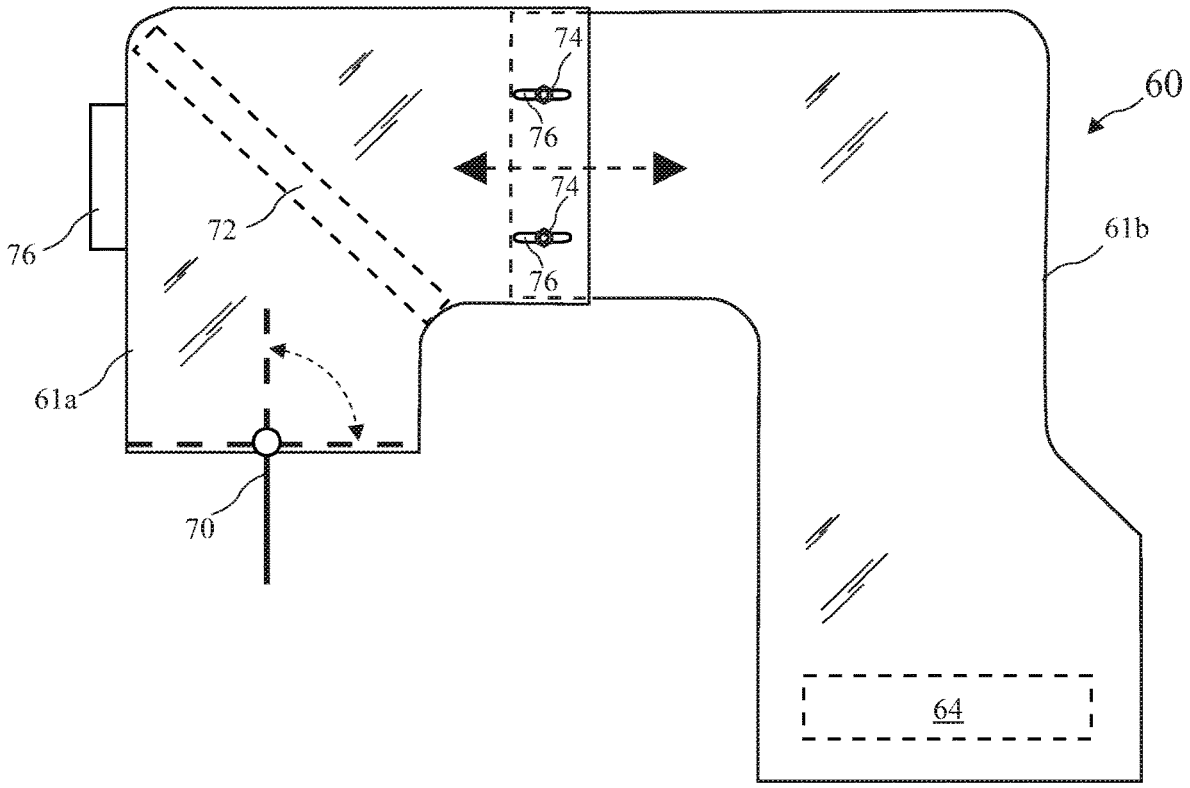
FIG. 10 is a cross-section of an offset window fan according to the present invention.

A cross-section of an offset window fan 60 is shown in FIG. 10. The window fan 60 includes a two part telescoping housings 61*a* and 61*b* allowing the housing to the adjusted to fit an opening the window 15 is installed in. The housings 61*a* and 61*b* may be held in position by fasteners 74 cooperating with slots 76. A filter 72 resides inside either the housing 61*a* or 61*b* and is preferably angled to allow the largest filter size. A damper 70 may be opened when the window fan 60 is operating or closed when the window fan 60 is off.

A control panel and/or circuit 76 is shown on the housing 61*a* for control of the fan 64. The control panel 76 may include wireless communication with a Heating, Ventilation and Air Conditioning (HVAC) thermostat (for example a thermostat sold under the trademark Nest, Ecobee, or Honeywell) and with a local area network to remotely control the window fan 60, for example over the Internet using a smart phone. Examples of the wireless communication are WI-Fi®, a BLUETOOTH®, or other wireless communication. The operation of the window fan 60 and HVAC may be coordinated so they do not operate at the same time, or to coordinate their operation to maximum cooling, maximum heating, or more efficient operation. The window fan 60 may operate with the outdoor temperature sensor 28*a* eliminated by using Internet of Things (IoT) to obtain nearby weather station temperature.

Figure 11:
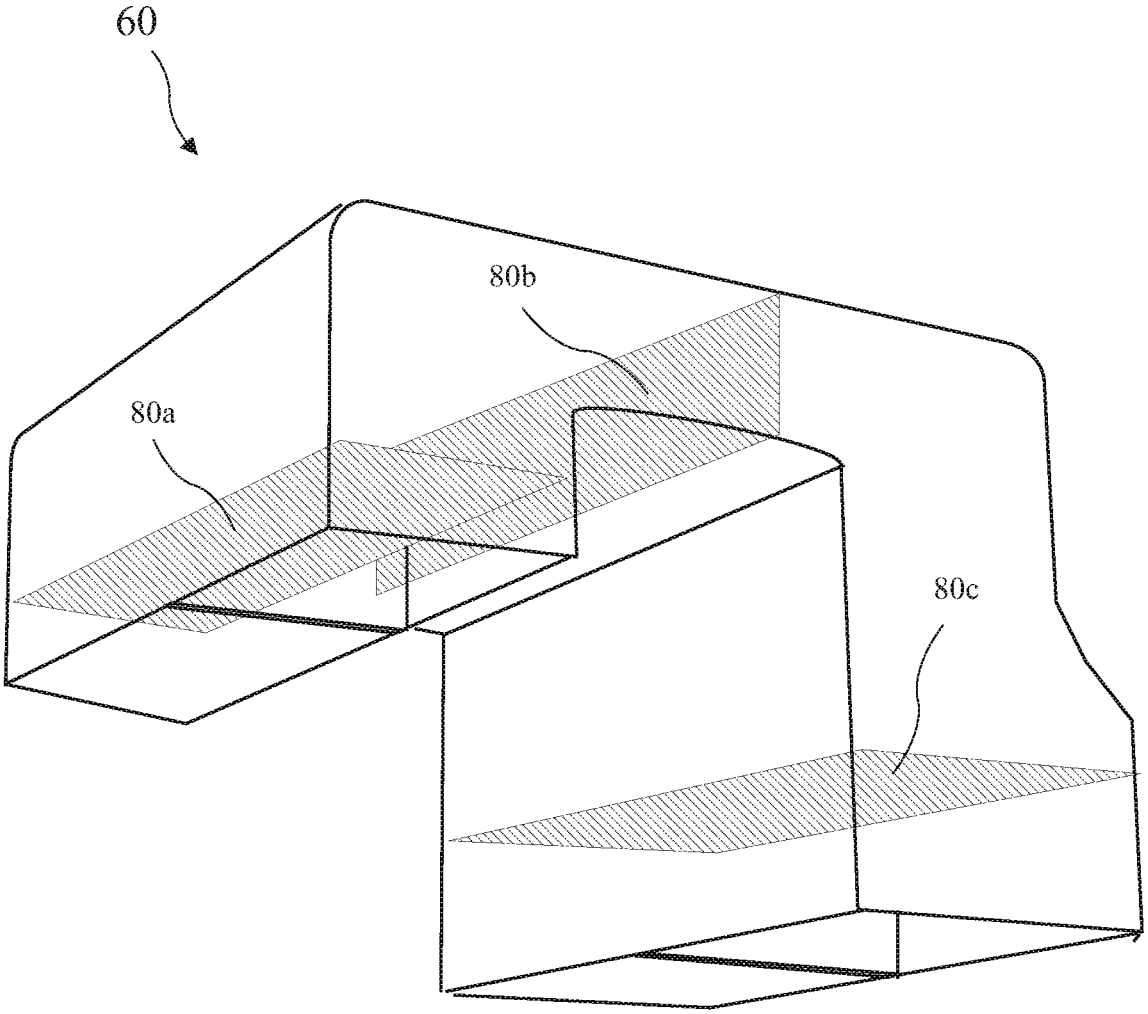
FIG. 11 shows a cross-sections of the interior, waste, and exterior portions of the offset window fan according to the present invention.

The interior portion 60*a* has a cross-section 80*a*, the waist portion 60*b* has a cross-section 80*b*, and the exterior portion 60*c* has a cross-section 80*s*, seen in FIG. 11.

While the invention herein disclosed has been described by means of specific embodiments and applications thereof, numerous modifications and variations could be made thereto by those skilled in the art without departing from the scope of the invention set forth in the claims.

I claim:

1. A method for controlling room temperature, comprising:

mounting an offset window fan in a window of an temperature controlled room, the offset window fan comprising:

a fan housing having:

an interior portion in fluid communication with a room interior and reaching inward and generally downward;

an exterior portion in fluid communication with a room exterior and reaching outward into the room exterior and generally downward;

a center portion configured to reside in a window opening and between the interior portion and the exterior portion and in fluid communication with both the interior portion and the exterior portion; and an independently controlled first fan in the exterior portion of the fan housing and at least partially miss-aligned from the center portion;

an independently controlled second fan in the exterior portion of the fan housing and at least partially miss-aligned from the center portion; and the center portion having a smaller cross-section than the exterior portion, reducing an amount of window area blocked by the fan housing;

an outdoor temperature sensor;

an indoor temperature sensor;

a user operated control;

a processor operatively connected to the control, the indoor temperature sensor, the outdoor temperature sensor, the first fan, and the second fan, operating the first fan to draw indoor air from the room and the second fan to draw outdoor air into the room, for a sampler period of time;

sensing an indoor air temperature Ti in an air flow created by the first fan by the outdoor temperature sensor during the sampler period of time;

sensing an outdoor air temperature To in an air flow created by the second fan by the indoor temperature sensor during the sampler period of time;

the processor receiving the indoor temperature Ti from the indoor temperature sensor;

the processor receiving the outdoor temperature To from the outdoor temperature sensor;

the processor comparing the indoor temperature Ti to the target temperature Tt;

the processor comparing the indoor temperature Ti to the outdoor temperature To;

activating the first fan and the second fan to draw outside air into the temperature controlled room if a first criteria comprising in the heating mode, the indoor temperature Ti is less than the target temperature Tt, and the indoor temperature Ti is less than the outdoor temperature To is met;

activating the first fan and the second fan to draw outside air into the temperature controlled room if a second criteria comprising in the cooling mode, the indoor temperature Ti is greater than the target temperature Tt, and the indoor temperature Ti is greater than the outdoor temperature To is met; and deactivating the first fan and the second fan if neither the first criteria nor the second criteria are met.

2. The dual wall mount fan of claim 1, further including periodically testing for the first criteria and the second criteria after a waiting time interval, and activating the first fan and the second fan if either the first criteria or the second criteria is met, otherwise, deactivating the first fan and the second fan.

3. The dual wall mount fan of claim 1, wherein the sample period of time is between three seconds and 10 seconds.

4. The dual wall mount fan of claim 1, further including attaching the outdoor temperature sensor to an end of a rod extending outward into the room exterior from the housing.

5. A method for controlling room temperature, comprising:

mounting an offset window fan in a window of an temperature controlled room, the offset window fan comprising:

a fan housing having:

an interior portion in fluid communication with a room interior or an exterior portion in fluid communication with a room exterior;

a center portion configured to reside in a window opening and adjacent to the interior portion or the exterior portion and in fluid communication with the interior portion or the exterior portion;

an independently controlled first fan in the interior portion or the exterior portion of the fan housing and at least partially miss-aligned from the center portion;

an independently controlled second fan in the interior portion or the exterior portion of the fan housing and at least partially miss-aligned from the center portion; and the center portion has a smaller cross-section than either the interior portion or the exterior portion containing the first fan or the second fan;

an outdoor temperature sensor;

an indoor temperature sensor;

a user control;

a processor operatively connected to the control, the indoor temperature sensor, the outdoor temperature sensor, the first fan, and the second fan, operating the first fan draw indoor air from the room and the second fan to draw outdoor air into the room, for a sampler period of time of five seconds;

sensing an indoor air temperature Ti in an air flow created by the first fan by the outdoor temperature sensor during the sampler period of time;

sensing an outdoor air temperature To in an air flow created by the second fan by the indoor temperature sensor during the sampler period of time;

the processor receiving the indoor temperature Ti from the first temperature sensor;

the processor receiving the outdoor temperature To from the second temperature sensor;

the processor comparing the indoor temperature Ti to the target temperature Tt;

the processor comparing the indoor temperature Ti to the outdoor temperature To;

activating the first fan and the second fan to draw outside air into the temperature controlled room if a first criteria comprising in the heating mode, the indoor temperature Ti is less than the target temperature Tt, and the indoor temperature Ti is less than the outdoor temperature To is met;

activating the first fan and the second fan to draw outside air into the temperature controlled room if a second criteria comprising in the cooling mode, the indoor temperature Ti is greater than the target temperature Tt, and the indoor temperature Ti is greater than the outdoor temperature To is met;

deactivating the first fan and the second fan if neither the first criteria nor the second criteria are met;

periodically re-testing for the first criteria and the second criteria after a waiting time interval, and activating the first fan and the second fan if either the first criteria or the second criteria is met, otherwise, deactivating the first fan and the second fan.

* * * * *